United States Patent [19]

Schäfer

[11] 4,366,691

[45] Jan. 4, 1983

[54] APPARATUS FOR CIRCUMFERENTIALLY CORRUGATING A TUBE

[76] Inventor: August W. Schäfer, Bautenberger Str. 37, 5901 Wilnsdorf-Wilden, Fed. Rep. of Germany

[21] Appl. No.: 244,242

[22] Filed: Mar. 16, 1981

[30] Foreign Application Priority Data

Sep. 18, 1980 [DE] Fed. Rep. of Germany ..... 3035234

[51] Int. Cl.[3] ..... B21D 15/00; F16H 37/06

[52] U.S. Cl. ..... 72/84; 72/370; 74/681; 74/665 F; 74/675

[58] Field of Search ..... 72/84, 85, 110, 247, 72/370; 74/681, 682, 665 F, 675

[56] References Cited

U.S. PATENT DOCUMENTS

| | | | |
|---|---|---|---|
| 1,368,413 | 2/1921 | Stiefel | 72/78 |
| 2,911,760 | 11/1959 | Smith | 74/675 X |
| 3,383,957 | 5/1968 | McCann | 74/675 X |
| 3,564,888 | 2/1971 | Miller | 72/110 |

FOREIGN PATENT DOCUMENTS

| | | | |
|---|---|---|---|
| 2831202 | 1/1980 | Fed. Rep. of Germany | 72/84 |

*Primary Examiner*—Lowell A. Larson
*Attorney, Agent, or Firm*—Karl F. Ross

[57] ABSTRACT

An apparatus for forming a plurality of an annular non-helical corrugations in a cylindrical tube has two generally parallel shafts that can be displaced toward and away from each other and that are driven oppositely and synchronously by a common main drive. A central roller disk is fixed on one of the shafts and a pair of axially displaceable outer disks flank this disk on the one shaft. A pair of axially displaceable roller disks are provided on the other shaft each lying between a respective one of the outer disks of the one shaft and the central disk. Respective threaded spindles adjacent the shafts threadedly engage the respective displaceable roller disks and these spindles are threaded such that when rotated in one rotational sense the respective disks move axially together and vice versa. A pair of summing transmissions each have an output connected mechanically to the respective spindle, a first rotary input connected to the main drive, and a second rotary input connected to a secondary drive so that the spindles can be rotated at a rate determined by the rotation speeds and directions of the two respective inputs.

8 Claims, 3 Drawing Figures

APPARATUS FOR CIRCUMFERENTIALLY CORRUGATING A TUBE

FIELD OF THE INVENTION

The present invention relates to an apparatus for forming a generally cylindrical tube with annular nonhelical corrugations. More particularly this invention concerns an apparatus for making a so-called corrugated tube compensator.

BACKGROUND OF THE INVENTION

A corrugated tube compensator, for instance of the type usable as an expansion joint between straight lengths of pipe, is formed with a plurality of annular nonhelical corrugations. Such a shape is relatively difficult to make. Forming it by rolling up an appropriately corrugated sheet has been found impossible, so that recourse has been had to making it, corrugation at a time, by making U-section rings and then welding them together.

In my German patent application No. 2,831,202, published Jan. 24, 1980, I describe an apparatus for forming annular corrugations in a short cylindrical tube. This apparatus has a pair of shafts centered on and rotatable about respective shaft axes. One of these shafts is radially displaceable toward and away from the other. A central disk is fixed on one of the shafts and is flanked by a pair of axially displaceable outer disks. A pair of axially displaceable roller disks are provided on the other shaft each lying between a respective one of the outer disks of the one shaft and the central disk. Thus the disks are interleaved.

A main drive is connected mechanically to both of the shafts for synchronously and oppositely rotating same. In addition each of the shafts is associated with a respective spindle threadedly engaging the displaceable roller disks and rotatable to move the roller disks toward or away from one another. Each of these spindles has at its outer end a pinion meshing with a main drive gear carried directly on the respective shaft so that the axial advance of each of the roller disks will be exactly proportional to the rotation rate for the respective shafts.

In use a tubular sleeve is fitted over one of the shafts which is then moved toward the other shaft so as to lightly grip the tube between the roller disks. Then the two shafts are simultaneously rotated and urged radially toward each other. At the same time the disks move axially inwardly so that the entire tube is regularly deformed to have annular nonhelical corrugations.

Such a system is an enormous advance over the prior-art method of piecemeal assembly of a corrugated tube compensator. Nonetheless certain problems remain. In particularly thick tubes, for example, it is occasionally difficult to axially advance the roller disks toward one another and to radially displace the shafts toward one another at a relatively high speed, but it is necessary to move the roller disks at a high peripheral speed. Thus a tradeoff must be made between ideal rolling speed and axial advance speed for the roller disks. Furthermore the axial advance of the disks is directly proportional to the rotation rate, so that as soon as the device is started up the disks start to move axially together.

OBJECTS OF THE INVENTION

It is therefore an object of the present invention to provide an improved apparatus for forming a plurality of annular nonhelical corrugations in a cylindrical tube.

Another object is to provide such an apparatus which overcomes the deficiencies of the above-described apparatus.

SUMMARY OF THE INVENTION

These objects are attained according to the instant invention in an apparatus of the above-described general type, but wherein the threaded spindles are not connected via respective fixed-ratio transmissions to the respective shafts, but instead are each connected to the output of a respective summing transmission having a first rotary input connected to the main output of the drive means that rotates the shafts and the second rotary input of which is connected to a secondary drive means. Thus, although it is possible to rotate the spindles at a rate which is exactly proportional to the rotation rate for the respective shaft, the proportionality can easily be varied by appropriately driving the second input of the summing transmission.

Thus it is possible with the secondary drive means to establish virtually any ratio between the rotation speed of the shaft and that of the respective spindle. Normally the rate at which the disks are shifted axially toward each other is related to the rate at which the two shafts are moved toward each other, so that the disks and shafts both reach their end positions at approximately the same time.

According to another feature of this invention each of the spindles is provided with an externally toothed pinion that engages internally into an internally and externally toothed ring gear that is centered on the respective shaft axis. Another respective pinion meshes externally with this ring gear and is directly driven by the output of the summing transmission. Such an arrangement is particularly useful when more than three disks are provided on a single shaft, as another set of spindles for another two disks can be driven through a stepup transmission from this ring gear, thereby allowing a multiplicity of corrugations to be formed in the tube.

According to the instant invention the gear ratios in the two summing transmissions connecting the two main outputs to the respective shafts and spindles are such that when the secondary input is stationary the output connected to the spindle does not rotate at all. When the secondary input is rotated in one direction the respective spindle will rotate in a predetermined direction, and when rotated in the opposite direction it will correspondingly rotate oppositely. Thus under normal circumstances a tube to be corrugated is fitted between the roller disks and can be rolled around a few times to insure that it is perfectly centered before the axial displacement of the disks toward one another is started along with the radial displacement of the shafts toward each other.

SPECIFIC DESCRIPTION

Figure 1:
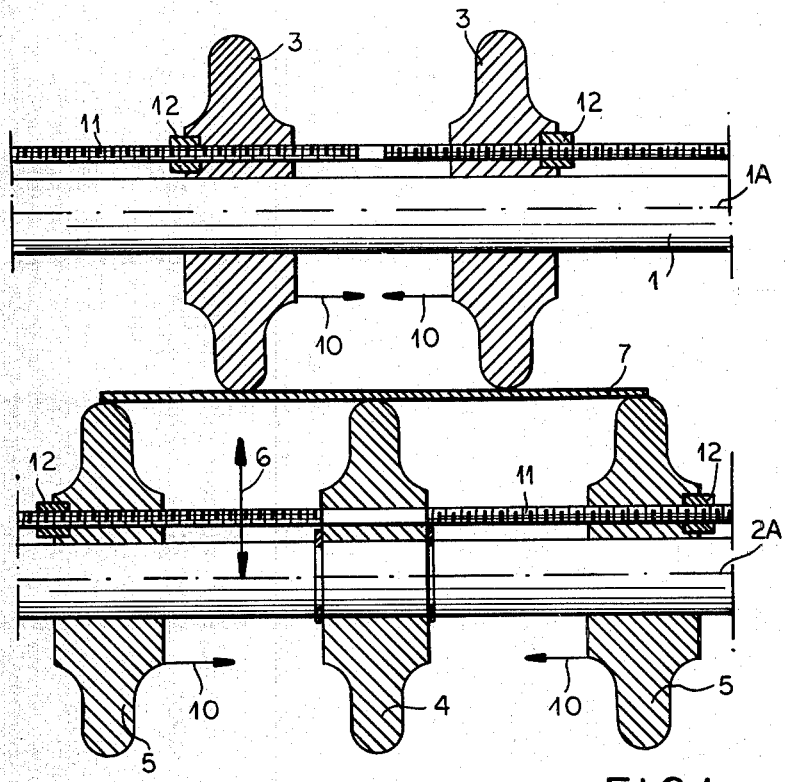
FIGS. 1 and 2 are axial sections through a portion of the apparatus according to the instant invention at the start and end of a corrugating-rolling operation.
Figure 2:
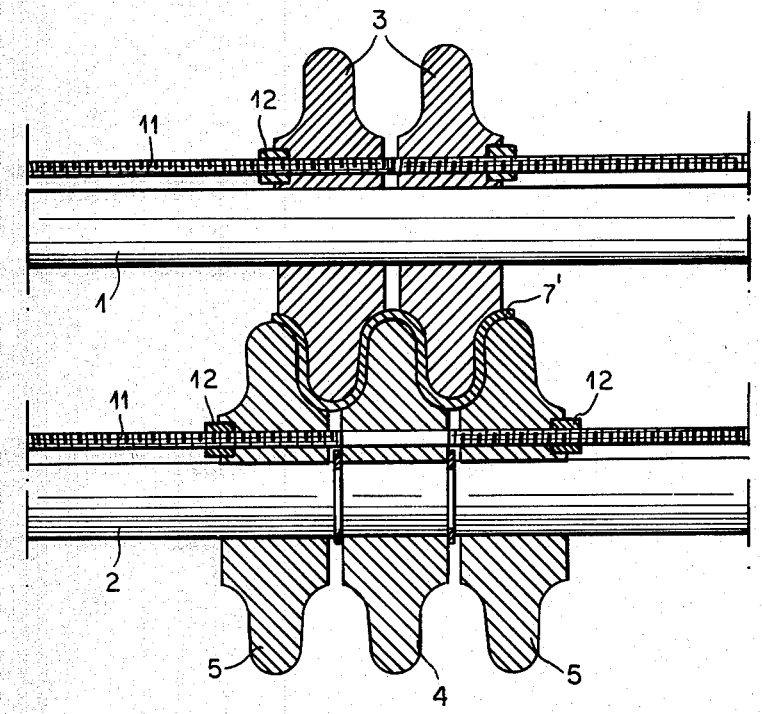

As seen in FIGS. 1 and 2 the apparatus according to the invention has a pair of main shafts 1 and 2 centered on respective parallel main axes 1A and 2A. The upper shaft 1 carries a pair of axially displaceable roller disks 3 that are rotationally coupled to the shaft 1 by means of unillustrated splines or keys. The lower shaft 2 carries a central fixed roller 4 identical in shape to the rollers 3 but neither axially nor rotationally displaceable relative to the shaft 2. Flanking this fixed roller 4 are a pair of lower outer rollers 5 identical to the rollers 3 and axially displaceable along the shaft 2. These roller disks 5 are also rotationally coupled to the shaft 2.

Figure 3:
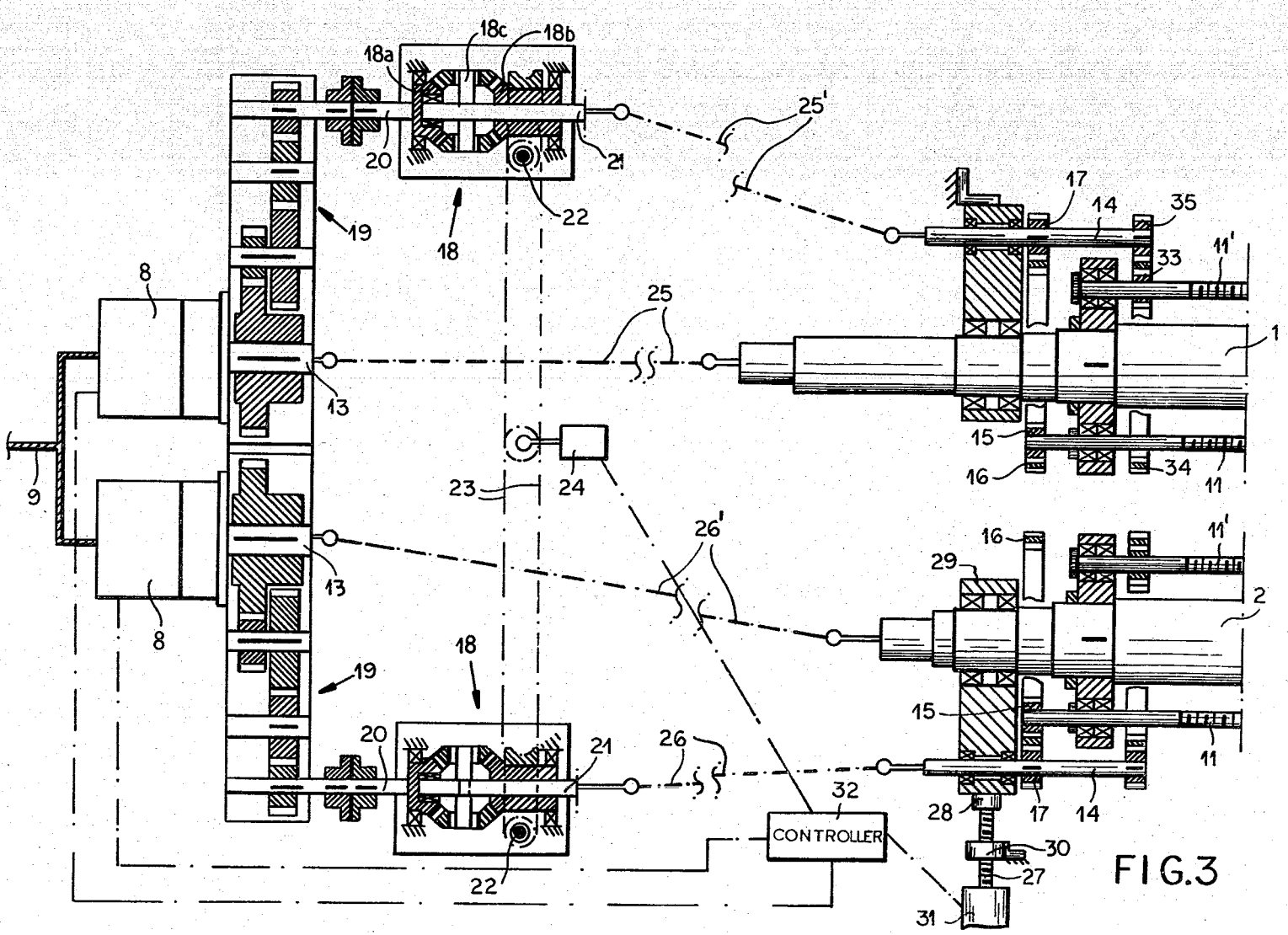
FIG. 3 is a partly diagrammatic and sectional view of the apparatus.

The shaft 2 can be displaced as shown by arrow 6 toward and away from the shaft 1 by means of a threaded spindle 27 shown in FIG. 3. This threaded spindle 27 engages a thrust bearing 28 on a support 29 for the shaft 2 and is threaded through a fixed nut 30. A motor 31 is operated by a controller 32.

A pair of identical hydraulic motors 8 connected to a common feedline 9 and operated by the controller 32 have outputs 13 connected via shafts 25 and 26' to the shafts 1 and 2, respectively. The shaft 26' is provided at its ends with universal joints and is axially extensible and contractile, being formed of a telescoping splined shaft and sleeve, so that the shaft 2 can move relative to the shaft 1.

Associated with each of the shafts 1 and 2 is at least one respective spindle 11 engaging at each of the outer disks 3 and 5 a threaded nut 12. The thread and the nut to one side of the central disk 4 are of one hand and to the other side are of the other hand so that rotation in one direction of, for example, the upper spindle 11 will move the disks 3 toward one another as indicated by arrows 10 and rotation in the opposite direction will move them apart.

The system according to the instant invention, as described in my above-cited German application, serves to form annular corrugations in a tubular workpiece a portion of which is shown in section at 7 in FIG. 1. This tubular workpiece is made of steel and is centered on an axis which lies somewhat above the axis 1A so that the disks 3 lie within the workpiece 7. In use the two shafts 1 and 2 with their respective roller disks 3–5 are rotated in opposite directions while simultaneously the shaft 2 is displaced toward the shaft 1 and the rollers 5 and 3 are displaced toward the center. This gives the workpiece section illustrated at 7' in FIG. 2. It is possible to brace these rollers with an arrangement such as described in my copending U.S. patent application Ser. No. 082,623 filed Oct. 9, 1979, now U.S. Pat. No. 4,312,208, patented Jan. 26, 1982.

As shown in better detail in FIG. 3 the spindles 11 are rotated in part by connection to the main outputs 13 for the main drive constituted by the two motors 8. Thus each of the main drives 13 is connected also to a step-down transmission 19 connected to an input 20 of a differential-type summing transmission 18 having another input 22 operated by means of a chain 23 from a secondary drive motor 24 and a single output 21. The two outputs 21 are connected via shafts 25' and 26 to shafts 14. In turn each of the shafts 14 carries an externally toothed pinion 17 engaging externally in a ring gear 16 which is also internally engaged by a pinion 15 carried on the spindle 11.

More particularly each of the summing transmissions 18 has one side gear **18*a* connected to the one input 20, another side gear 18*b* connected to the input 22, and a spider 18*c* connected to the output 21. The two inputs 22 of the two transmissions 18 are constituted by worms driven by sprockets over which is engaged the single endless chain 23 operated by the motor 24 which in turn is operated by the controller 32**.

In addition further spindles 11' which are intended for connection to further outer disk rollers that outwardly flank the disk rollers 5 or 3 carry pinions 33 meshing internally with ring gears 34 meshing externally with further pinions 35 carried on the shaft 14. Thus these shafts 11' can be driven at a greater rate so that even with a screw thread of the same pitch as the screw threads of the spindles 11 they will be able to drive their outer disk rollers at a greater speed.

With the system according to the instant invention, therefore, a workpiece such as shown at 7 in FIG. 1 is fitted over the rollers 3 and the motor 31 is actuated by the controller 32 until this workpiece 7 is just pinched between the rollers 3 on one side and 4 and 5 on the other. The drive motors 8 are started up so as to synchronously and oppositely rotate the two shafts 1 and 2 and their respective disk rollers to ascertain that this workpiece is properly centered and runs true. Once this is ascertained the motor 24 is started as is the motor 31 so as simultaneously to move the outer disks 3 and 5 together as shown by FIG. 1 while moving the shafts 1 and 2 toward each other into the position of FIG. 2. The relative motions are established so that the position shown in FIG. 2 is reached where the workpiece is transformed into a corrugated compensator 7'.

With the system according to the instant invention, therefore, it is possible to tailor the deformation speed to the particular type of workpiece. The rate of rotation does indeed determine the rate of displacement of the roller disks 3 and 5 toward one another, so that if the system is stopped the displacement will stop, but nonetheless this rate can be varied to form virtually any proportion relative to the rotation rate for the shafts 1 and 2.

I claim:

1. An apparatus for forming a plurality of annular nonhelical corrugations in a cylindrical tube, said apparatus comprising:

two generally parallel shafts centered on and rotatable about respective shaft axes;

means for displacing said shafts radially toward and away from each other;

main drive means having a main output connected mechanically to both of said shafts for synchronously and oppositely rotating same;

a central roller disk fixed on one of said shafts;

a pair of axially displaceable outer disks on said one shaft flanking said central disk;

a pair of axially displaceable roller disks on the other shaft and each lying between a respective one of said outer disks and said central disk;

respective threaded spindles adjacent said shafts and threadedly engaging the respective displaceable roller disks, said spindles being threaded such that when rotated in one rotational sense the respective disks move axially together and when rotated in the opposite rotational sense the respective disks move axially apart;

means including a summing transmission having a pair of outputs connected mechanically to the respective spindles, a first rotary input connected to said main output of said drive means, and a second rotary input for jointly and synchronously rotating said spindles at a rate determined by the rotation speeds and directions of said inputs; and secondary drive means connected to said second input for rotating same.

2. The apparatus defined in claim 1 wherein said main drive means has two such main outputs connected respectively to said shafts, said means for jointly and synchronously rotating said spindles including two such summing transmissions having their first inputs respectively connected to said main outputs, their second inputs ganged and connected to said secondary drive means, and their outputs respectively connected to said spindles.

3. The apparatus defined in claim 2 wherein said secondary drive means includes an endless chain interconnecting said inputs.

4. The apparatus defined in claim 1, further comprising an externally toothed pinion on each of said spindles, a respective internally and externally toothed ring gear centered on the respective shaft axis and meshing internally with the respective pinion, and another respective pinion meshing externally with the respective ring gear and directly driven by said output of said summing transmission.

5. The apparatus defined in claim 1, further comprising a stepdown transmission between said main drive output and said first input.

6. The apparatus defined in claim 1 wherein the ratios in said summing transmission are such that when said second input is stationary said pair of outputs are also stationary.

7. The apparatus defined in claim 6 wherein said ratios are such that when said second input is rotated in one direction said pair of outputs rotate in one respective rotational sense, and when rotated in the opposite direction said pair of outputs rotate in the opposite rotational sense.

8. The apparatus defined in claim 1 wherein one of said shafts is radially displaceable toward and away from the other shaft and is provided with an extensible connection shaft connected between said one shaft and said main drive output.

* * * * *